US005762533A

United States Patent [19]

Tilbor et al.

[11] Patent Number: 5,762,533

[45] Date of Patent: Jun. 9, 1998

[54] TOY VEHICLE WITH ADJUSTABLY POSITIONED WHEELS

[75] Inventors: Neil Tilbor; Michael G. Hetman, both of New Smyrna Beach, Fla.; Jonathan A. Jaffe, Voorhees, N.J.

[73] Assignee: Mattel, Inc., Mt. Laurel, N.J.

[21] Appl. No.: 582,791

[22] Filed: Jan. 4, 1996

[51] Int. Cl.[6] ..... A63H 17/267

[52] U.S. Cl. ..... 446/466; 446/456; 446/462; 446/463; 446/469; 280/43.23

[58] Field of Search ..... 446/437, 441, 446/448, 465, 466, 469; 180/21, 7.1, 209; 280/43.13, 43.21, 43.22, 43.23

[56] References Cited

U.S. PATENT DOCUMENTS

| | | | |
|---|---|---|---|
| 994,019 | 5/1911 | Maxwell . | |
| 2,753,675 | 7/1956 | Harp | 280/43.23 |
| 3,297,336 | 1/1967 | Lassen | 280/43.21 |
| 4,213,270 | 7/1980 | Oda . | |
| 4,459,776 | 7/1984 | Jaworski et al. | 446/462 |
| 4,508,516 | 4/1985 | D'Andrade et al. | 446/443 |
| 4,553,947 | 11/1985 | Weiland et al. | 446/463 |
| 4,693,696 | 9/1987 | Buck | 446/465 |
| 4,696,655 | 9/1987 | D'Andrade et al. | 446/466 |
| 4,773,889 | 9/1988 | Rosenwinkel et al. | 446/448 |
| 4,776,415 | 10/1988 | Brice | 446/466 |
| 4,822,316 | 4/1989 | Shaffer et al. | 446/466 |
| 4,850,929 | 7/1989 | Genevey | 446/466 |
| 5,019,009 | 5/1991 | Chao-Chin et al. | 446/437 |
| 5,022,884 | 6/1991 | Hippely et al. | 446/470 |
| 5,129,851 | 7/1992 | Villanueva | 446/469 |
| 5,135,427 | 8/1992 | Suto et al. | 446/456 |
| 5,167,563 | 12/1992 | Saffer | 446/466 |
| 5,228,880 | 7/1993 | Meyer et al. | 446/465 |
| 5,273,480 | 12/1993 | Suto | 446/456 |
| 5,326,128 | 7/1994 | Cromley, Jr. | 280/656 |
| 5,334,077 | 8/1994 | Bailey | 446/466 |
| 5,338,246 | 8/1994 | Suto | 446/466 |
| 5,372,534 | 12/1994 | Levy et al. | 446/457 |
| 5,429,543 | 7/1995 | Tilbor et al. | 446/456 |

*Primary Examiner*—Robert A. Hafer
*Assistant Examiner*—Jeffrey D. Carlson
*Attorney, Agent, or Firm*—Panitch, Schwarze Jacobs & Nadel, P.C.

[57] ABSTRACT

A toy vehicle has a chassis, two axles, two pairs of wheels and four identical wheel support housings. Each wheel is mounted on a separate end of a separate one of the two axles by one of the wheel support housings. The wheels are mounted for rotation on the housings, which are mounted off center on the axles so as to rotate eccentrically around the axles with the wheels. Wheels on either lateral side of the chassis are driven by separate propulsion motors driving separate gear trains in the chassis to propel the vehicle. Collars around the axles and pairs of gears within the wheel support housings themselves couple the wheels with the gear trains. The axles are rotated together through a third shaft driven by a separate accessory motor to vary the eccentric position of the wheel support housings and thereby alter the appearance and performance of the vehicle. Slip clutches with angled, mating faces, effectively coupling the axles with the third shaft. The faces are spring biased together and remain engaged over limited ranges of angular movement. This permits each slip clutch to act as a suspension for the wheel support housings and the wheels supported on each axle protecting those downstream drive components from being overloaded and broken. The clutches further permit alteration of the phase between the wheel axles. Independent radio control of an accessory motor and two propulsion motors is provided.

29 Claims, 5 Drawing Sheets

TOY VEHICLE WITH ADJUSTABLY POSITIONED WHEELS

FIELD OF THE INVENTION

The present invention relates to toy vehicles and, in particular, to toy vehicles having unusual transformation and action capabilities.

BACKGROUND OF THE INVENTION

Toy vehicle are well known. Remotely controlled and radio-controlled toy vehicles, in particular, have come to constitute a significant specialty toy market.

Toy manufacturers attempt to duplicate well known vehicles, as well as the latest in automotive developments, including specialty entertainment vehicles. In addition, manufacturers constantly seek new ways and features to add innovative action to such toys to make such vehicles more versatile and/or entertaining.

U.S. Pat. No. 4,850,929, for example, discloses an unpowered toy vehicle provided with "pivot axles". Each "pivot axle" is combined in a wheel assembly with a pair of road contacting, vehicle supporting wheels and a shaft on which the wheels are mounted. The shaft is supported in a pair of stirrups, which extend transversely from the ends of the pivot axle, parallel to yet spaced laterally from the pivot axle. The pivot axle can be coupled with the chassis in any of three positions which are shown in FIGS. 5–7 of that patent. The configuration of the vehicle is changed solely by mechanical adjustment.

SUMMARY OF THE INVENTION

In one aspect the invention is a toy vehicle comprising: a chassis having opposing lateral sides; an axle having a central axis and supported by the chassis for rotation with ends of the axle extending laterally outwardly from the opposing lateral sides of the chassis; a pair of vehicle supporting, ground contacting wheels located parallel to one another on the opposing lateral sides of the vehicle; and a pair of wheel support housings, each wheel support housing being fixedly secured on a separate end of the axle at a location on the wheel support housing off geometric center of the wheel support housing for eccentric rotation of the wheel support housing about the axle with rotation of the axle, each wheel of the pair being mounted on a separate one of the pair of wheel support housings for rotation on the one wheel support housing about a geometric center of the wheel radially displaced away from the central axis.

In another aspect the invention is a toy vehicle comprising: a chassis having opposing lateral sides; a first axle having a central axis and being supported on the chassis for rotation on the chassis about the central axis of the first axle; at least a first wheel supported on the first axle with a geometric center of the first wheel being radially displaced away from the central axis of the first axle; a second axle having a central axis and being supported on the chassis for rotation on the chassis about the central axis of the second axle, the central axes of the first and second axles being parallel to one another and longitudinally displaced from one another on the chassis; at least a second wheel supported on the second axle with geometric center of the second wheel being radially displaced away from the central axis of the second axle; and a shaft rotatably coupled with each of the first and second axles for simultaneous rotation of the shaft with the first and second axles.

In yet another aspect the invention is a toy vehicle comprising: a chassis having opposing lateral sides; a first axle having a central axis, the first axle being supported laterally on the chassis for rotation about the central axis of the first axle; a first pair of wheels supported on separate ends of the first axle on either of the opposing lateral sides of the chassis with geometric centers of the first pair of wheels being radially displaced away from the central axis of the first axle; a second axle having a central axis, the second axle being supported laterally on the chassis for rotation about the central axis of the second axle with ends of the first axle projecting laterally outwardly from the opposing lateral sides of the chassis; a second pair of wheels supported on separate ends of the second axle on either of the opposing lateral sides of the chassis with geometric centers of the second pair of wheels being radially displaced away from the central axis of the second axle; and motor means drivingly coupled with at least one driven wheel on each of the opposing lateral sides of the vehicle for rotating each driven wheel without rotation of either of the first and second axles.

In still yet another aspect the invention is a toy vehicle comprising: a chassis; a first axle having a first central axis and being supported laterally on the chassis for rotation on the chassis about the central axis; a first vehicle-supporting, ground-contacting wheel having a geometric center; and a first wheel support housing supporting the first wheel for rotation of the first wheel on the wheel support housing about the geometric center of the first wheel, the wheel support housing being supported on the first axle for rotation of the first wheel support housing with respect to the chassis, the first central axis being radially displaced away from the geometric center of the first wheel and at least one of the first wheel and the first wheel support housing being engaged with the first axle for rotation with rotation of the first axle.

The invention is also a toy vehicle comprising: a chassis; a first axle having a first central axis and being supported laterally on the chassis for rotation on the chassis about the central axis; a first vehicle-supporting, ground-contacting wheel having a geometric center; a first wheel support housing supporting the first wheel for rotation of the first wheel on the wheel support housing about the geometric center of the first wheel, the wheel support housing being supported from the chassis for rotation about a first axis displaced radially away from the geometric center of the first wheel; and a first slip clutch rotatably coupling the first wheel support housing with the chassis, the first slip clutch including a spring mounted to permit a limited rotational movement of the wheel support housing on the chassis about the central axis and to bias the wheel support housing back to the nominal angular position within the range of limited angular movement.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings which are diagrammatic.

DETAILED DESCRIPTION OF PREFERRED EMBODIMENTS

Figure 1:
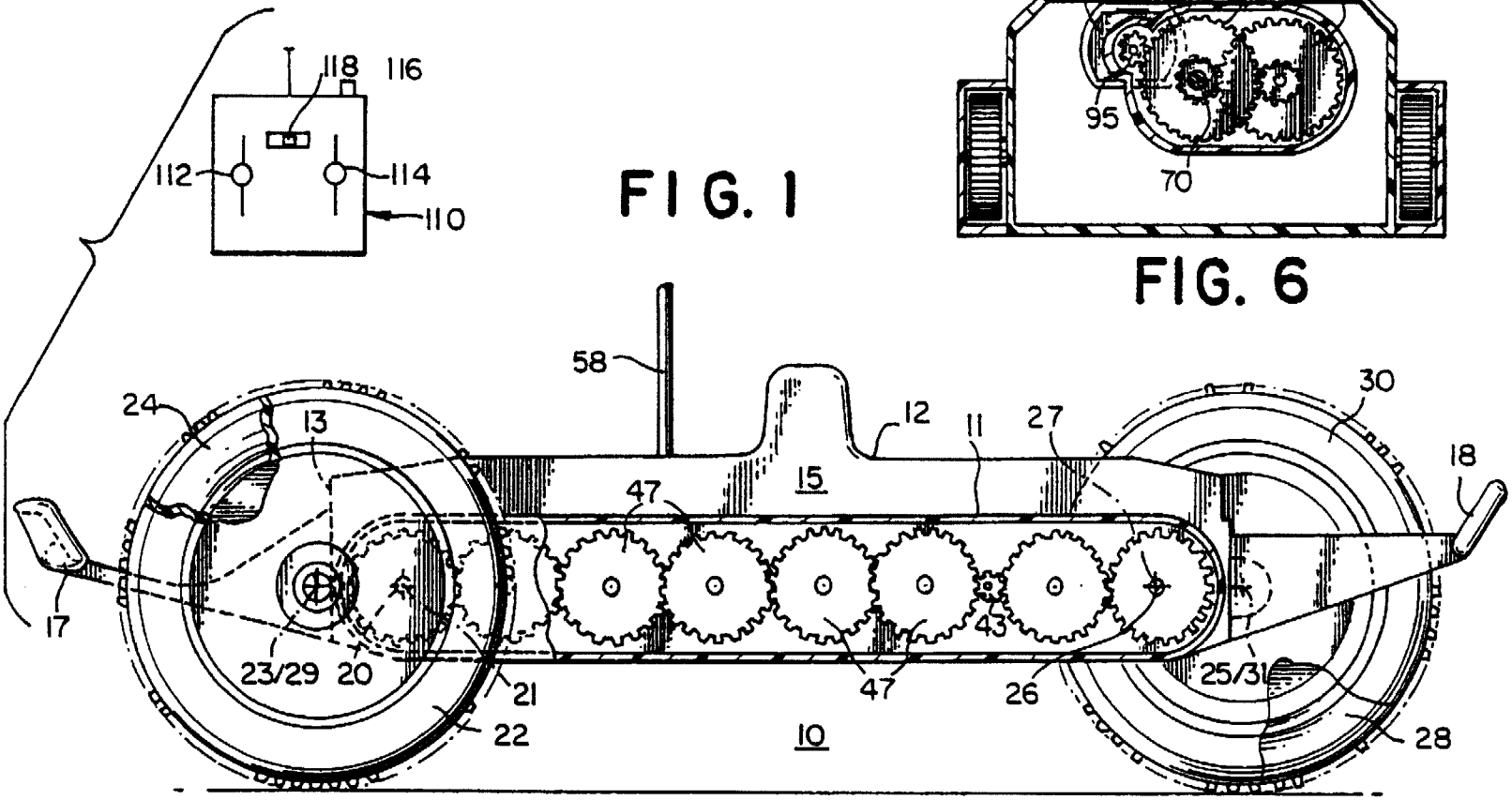
FIG. 1 is a side elevation of a basic toy vehicle embodiment of the present invention in which a body has been omitted for clarity and in which parts of a chassis and some wheels have been partially broken away.
Figure 2:
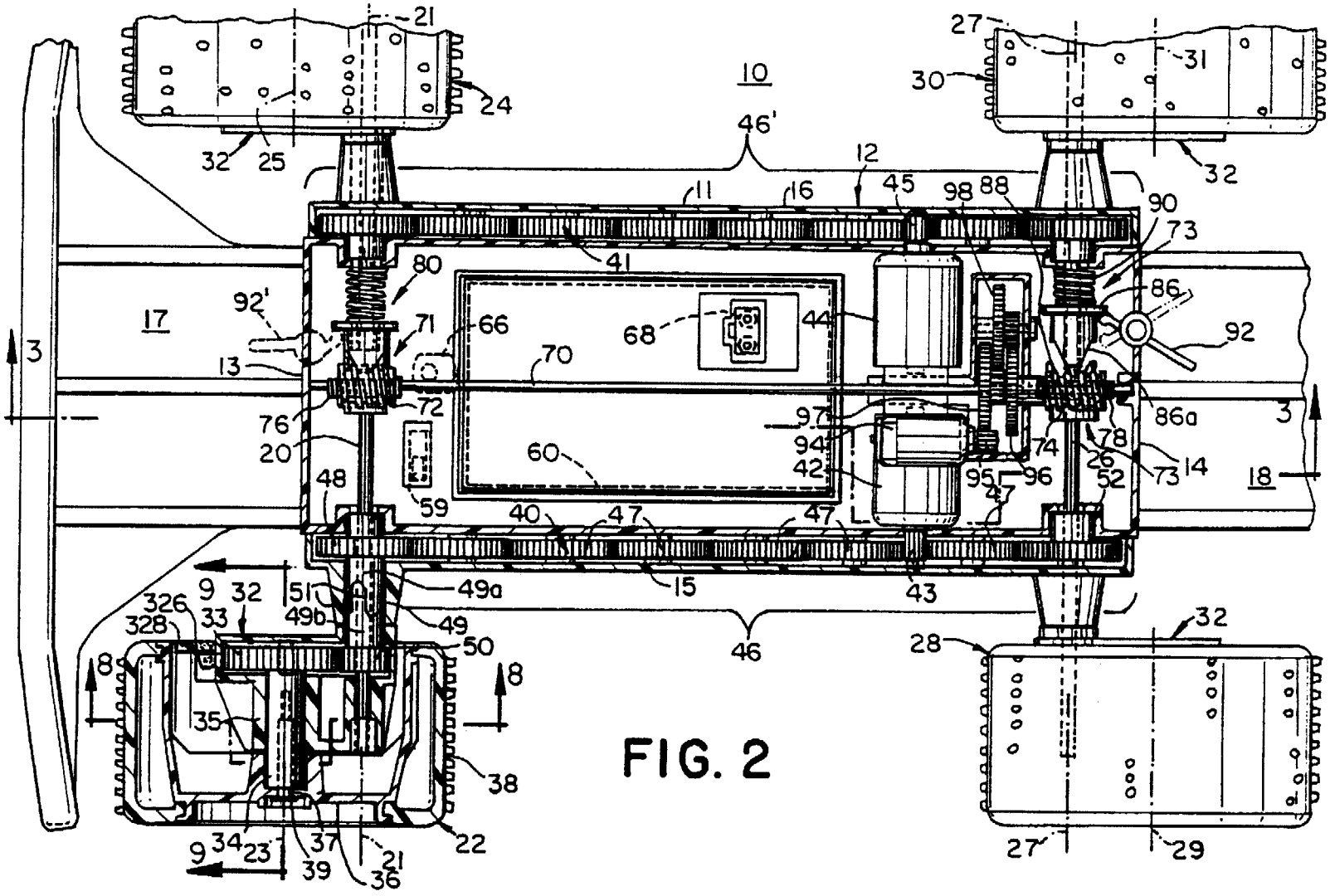
FIG. 2 is a top plan view of the vehicle of FIG. 1 in which an upper side of a housing defining the vehicle chassis and an upper side of one wheel have been broken away.
Figure 3:
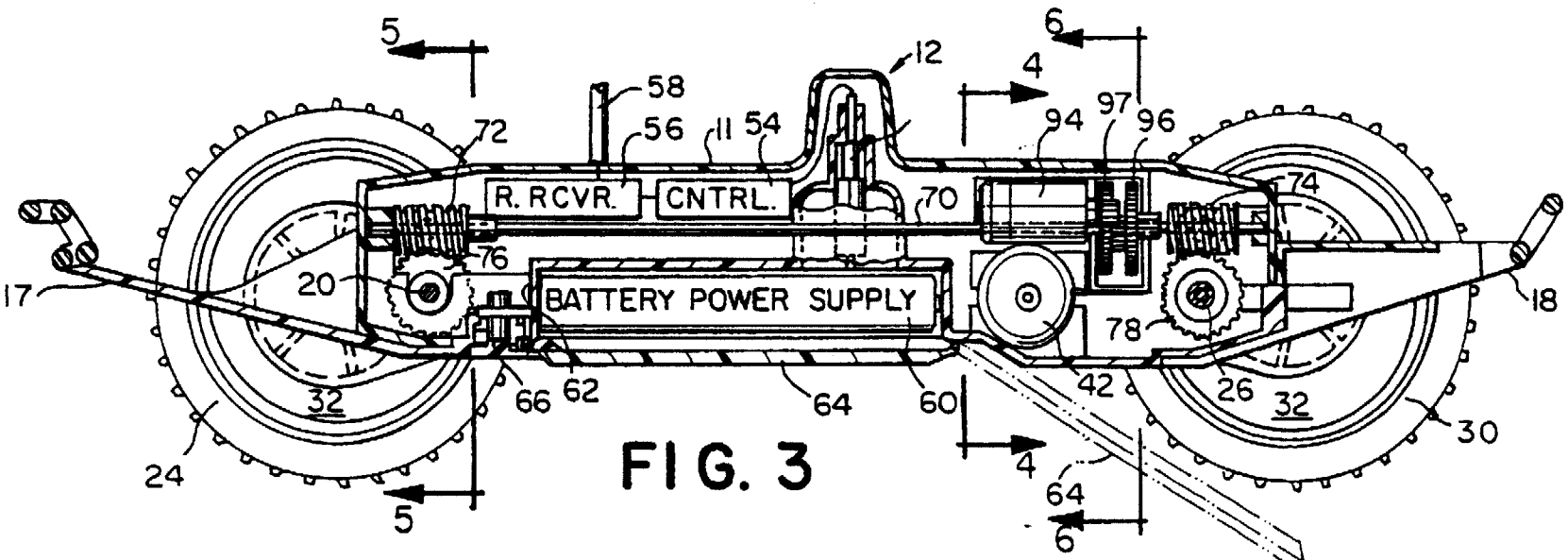
FIG. 3 is a cross-sectional elevation taken along the lines 3—3 of FIG. 2.

In the drawings, like numerals are used to indicate like elements throughout. There is shown in the figures a toy vehicle of the present invention indicated generally at 10. Referring particularly to FIGS. 1–3, the vehicle 10 includes a housing 11 which encloses and protects various working parts of the vehicle and which defines a chassis, indicated generally at 12. Chassis 12 supports the running gear and propulsive components of the vehicle 10. Vehicle 10 and chassis 12 have a front end 13, an opposing rear end 14 and a pair of lateral sides 15 and 16 extending between the front and rear ends. A front bumper 17 and a rear bumper 18 are preferably provided extending forwardly and rearwardly from the front and rear ends 13 and 14, respectively, of the chassis 12. The bumpers 17 and 18 are preferably each symmetric with respect to a longitudinal centerline of the vehicle and at least the front bumper preferably extends laterally beyond the lateral sides of the vehicle wheels to protect the wheels and their drive mechanisms.

Vehicle 10 further includes a first shaft constituting a first, front axle 20, which is supported laterally on the chassis 12 with ends of the axle extending laterally outwardly from the opposing lateral sides 15 and 16 of the chassis 12. Shaft/axle 20 has a circular cross-sectional shape and a central axis 21. Shaft/axle 20 preferably is supported by the chassis 12 for rotation on the chassis about central axis 21. A pair of ground-contacting, vehicle-supporting front wheels 22 and 24 are supported on the ends of the front axle 20 parallel to one another on the opposing lateral sides 15 and 16. The vehicle 10 is further provided with a second shaft constituting a second, rear axle 26 having a circular cross-sectional shape and central axis 27. The rear axle 26 is also supported laterally on the chassis 12 with ends of the axle 26 extending laterally outwardly through the opposing lateral sides 15 and 16 for rotation on the chassis about its central axis 27. The second axle 26 and its central axis 27 are thus longitudinally displaced away from the first axle 20 and its central axis 21. A second pair of ground-contacting, vehicle-supporting rear wheels 28 and 30 are supported on the ends of the rear axle 26.

Each wheel 22, 24, 28 and 30 has a geometric center indicated at 23, 25, 29 and 31, respectively. According to an important aspect of the invention, each of the pair of front wheels 22 and 24 and each of the pair of rear wheels 28 and 30 is mounted off geometric center on the front axle 20 and rear axle 26, respectively. The geometric centers 23 and 25 of the front wheels 22 and 24 and the geometric centers 29 and 31 of the rear wheels 28 and 30 are indicated in FIG. 2, spaced radially away from the central axes 21 and 27 of the front and rear axles 20 and 26, respectively, and vice versa.

Figure 8:
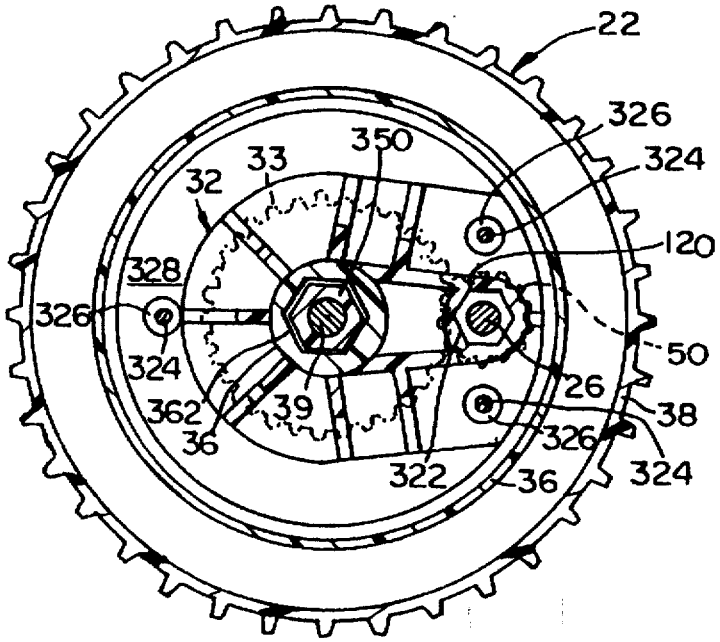
FIG. 8 is a side view of a wheel housing taken along lines 8—8 of FIG. 2.

Still referring to FIG. 2, according to another important aspect of the invention, each of the wheels 22, 24, 28 and 30 has a construction like that depicted for the left front wheel 22, which has been broken away. Each of the wheels 22, 24 and 28, 30 is supported on and mounted to its respective axles 20 and 26 by a wheel support housing 32, one of which is also broken away in FIG. 2 within wheel 22. FIG. 8 is a face view of the wheel support housing 32 within wheel 22. Housing 32 is supported on and preferably fixedly secured directly on the axle 20 off geometric center 23 of the supported wheel 22 and off geometric center of the housing 32 for eccentric rotation of the wheel support housing 32 with the wheel 22 about the axle 20 and with respect to the chassis 12, preferably with rotation of the axle 20. Each of the wheels 22, 24, 28, 30 is mounted on its own identical wheel support housing 32 for rotation on the wheel support housing 32 about the respective geometric center 23, 25, 29, 31 of the wheel.

Propulsion of the vehicle 10 through the wheels 20, 22, 28 and 30 is preferably provided by separate left and right side drives indicated generally at 40 and 41, respectively. Preferably separate and independent first and second propulsion motors 42 and 44 are supported on the left and right halves of chassis 12. Each motor 42 and 44 drives a pinion 43 and 45, respectively. Each motor 42 and 44 is preferably electrically powered, variable speed and reversible. Referring first to the left drive 40, a gear train indicated generally at 46 is provided within housing 11 along the left lateral side 15 of the chassis between the first propulsion motor 42 and each of the left front and rear wheels 22 and 28. The preferred gear train 46 includes, in addition to the pinion 43, six preferably identical idler gears 47, five located forward of the pinion 43 and one located rearward of the pinion. The preferred gear train 46 further includes a first, front drive gear 48 and a second, rear drive gear 52. The first, front drive gear 48 preferably is mounted on the front axle 20 for free rotation with respect to the axle 20 on the left lateral side of 15 of the vehicle 10 proximal the left front wheel 20. The rear drive gear 52 preferably is mounted on the rear axle 26 for free rotation with respect to the rear axle also on the left lateral side 15 of the vehicle proximal the left rear wheel 28. Front drive gear 48 within the housing 11 preferably is coupled with a first wheel drive gear 50 located in the wheel support housing 32 by means of a drive collar 49, which extends through the left lateral side 15 of the housing 11 on the front axle 20. The drive collar 49 is preferably provided by two parts **49*a*, 49*b*, each having a matingly complementary, castellated end face facing the other to permit the two parts to be drivingly engaged together. The parts 49*a*, 49*b* are keyed together along break line 51 with part 49*a* of the drive collar 49 formed integrally with the drive gear 48 and the remaining part 49*b* of the collar 49 formed with the wheel drive gear 50 so that the latter can be provided as a separate element in the wheel support housing 32 and attach to the end of the front axle 20**.

Still referring to FIG. 2, a driven wheel gear 33 is provided in the wheel support housing 32 in engagement with the wheel drive gear 50. The outer circumferences of both gears 33 and 50 are indicated in phantom in FIG. 8. Referring to FIG. 2, preferably a wheel shaft 34 extends from one side of the driven wheel gear 33 through a journal 35 formed by a portion of the wheel support housing 32. The wheel 22 includes a hub 36 with a bore 37 concentric with the geometric center 23 of the wheel 22 and a tire 38. The wheel 22 is fixedly coupled to the shaft 34 by suitable means such as a collared screw 39, which is fixedly threaded into the shaft 34 so as to permit free rotation of the wheel 22 on the wheel support housing 32 with the wheel shaft 34 and driven wheel gear 33. The wheel support housing 32 preferably is itself fixedly secured to the proximal free end of the front axle 20 by any means suitable for the materials and construction techniques selected, for rotation with the front axle 20. For example, the wheel support housing 32 can be mounted directly on the proximal free end of the front axle 20 by staking (not shown) or by the method shown in FIG. 8 where a hexagonal nut 120 is pressed onto the axle 20 and is received in a mating hexagonal bore 322 formed in the wheel support housing 32. Rear wheel 28 is similarly mounted on a free end of rear axle 26 off geometric center by an identical wheel support housing also indicated at 32.

The second propulsion motor 44 is identically coupled with the right front and right rear wheels 24 and 30 through a second, right side gear train 46', which is a mirror image of the left side gear train 46, and identical wheel support housings 32, all previously described.

In this manner, each of the pair of front wheels 22 and 24 is mounted off geometric center to a separate free end of the front axle 20 through the front pair of wheel support housings 32 for rotation of the front wheels about their own geometric centers and the geometric centers of the wheel support housing and for rotation eccentrically with respect to the front axle on the front axle. The rear pair of wheels 28 and 30 are similarly mounted for similar rotation on and with respect to the rear axle 26.

Figure 9:
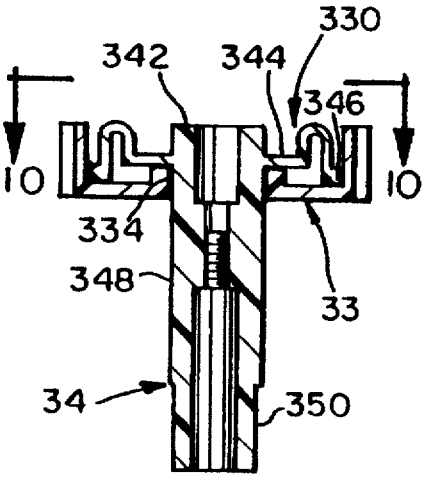
FIG. 9 is a cross-sectional view of one of the wheel shafts and drive wheel gears taken along the lines 9—9 of FIG. 2.
Figure 10:
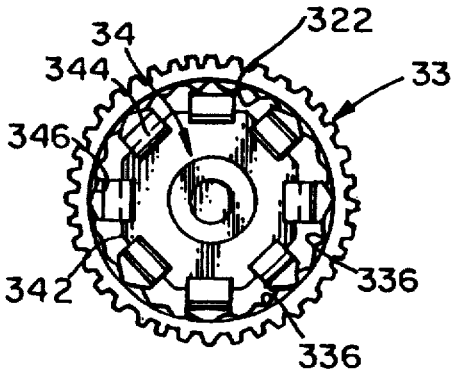
FIG. 10 is a face view of one of the driven wheel gears from lines 10—10 of FIG. 9.

FIGS. 9 and 10 provide details of a wheel slip clutch 330 preferably provided between the driven wheel gear 33 and the wheel shaft 34. Referring first to FIG. 9, the gear 33 is hollow and has a central bore 334 through which wheel shaft 33 extends. Referring to FIG. 10, the gear 33 includes along its circumferential inner surface, a series of regularly spaced protrusions 332. Referring to both FIGS. 9 and 10, the shaft 34 includes a head portion 342 located within the driven gear 33 which supports a plurality of radially outwardly extending flexible fingers 344. Fingers 344 support and outwardly bias teeth 346 into spaces 336 defined between adjoining protrusions 332. Should the wheel 22 (or 24, 28 or 30) become stuck, for any reason, while it is being powered for propulsion, the flexible fingers 344 permit the teeth 346 to ride over the protrusions 332, thereby allowing the gear 33 to slip on the shaft 34 and connected wheel 22. The wheel slip clutch 330 also permits the wheel 22 to be rotated with the shaft 34 when the gear 33 is not being driven to prevent breakage of its coupling with wheel 22 or stripping of any of the gears within housing 32 or along the propulsion gear train 46 previously described. The central portion 348 of shaft 34 is cylindrical to rotate freely in the wheel support housing 32. The opposing axial end 350 of the shaft is preferably geometrically configured, for example, hexagonally configured as depicted, to be received in a matingly shaped opening 364 in the wheel hub 36 (see FIG. 2).

The wheel support housing 32 may be fabricated by joining together molded halves in a conventional fashion, for example, by means of screws 324 extending through mating screw bosses 326 provided on the halves of the housing shown in FIG. 8. Preferably a generally U-shaped flange 328 is provided around the housing 32 to cover the gap between the housing 32 and the inner side of the wheel hub 36 and eliminate a potential pinch point created by that gap.

FIG. 3 depicts other electrical and electronic components provided in the vehicle for controlling and operating the propulsion motors 42 and 44. A preferably rechargeable battery power supply 60 is provided in the vehicle and is supported by the chassis 12. Preferably, the housing 11 defining the chassis 12 includes a battery compartment 62 covered by a hinged door 64, which can be closed by a latch 66 pivotally supported on the housing 11 adjoining one side of the door 64. An appropriately releasable electrical coupling 68 is provided between the battery power supply 60 and the remaining electrical components of the vehicle. These include a control circuit 54 and a radio receiver circuit 56, which is preferably coupled with the battery power supply 60 through the control circuit 54. The control circuit 54 further selectively couples or connects the battery power supply 60 with each of the propulsion motors 42 and 44. An antenna 58 can be provided coupled with the receiver circuit 56. A manual on-off switch 59 (in phantom) can be provided in circuit with the receiver circuit 56 and power supply.

According to an important aspect of this embodiment, a third, accessory shaft 70 is provided extending longitudinally on the chassis 12 and is coupled with each of the front and rear axles 20 and 26 for simultaneous rotation of the third shaft 70 with the front and rear axles through couplings 71 and 73, respectively. More particularly, a first, front worm 72 is fixedly mounted on the front end of the third shaft 70 and a second, rear worm 74 is fixedly mounted on the rear end of the third shaft 70 for rotation of each worm 72, 74 with the third shaft 70. A first worm gear 76 is mounted on the front axle 20 in engagement with the first worm 72 and completes coupling 71. A second worm gear 78 is mounted on the rear axle 26 in engagement with the second worm 74 and completes coupling 73.

Each of the worm gears 76 and 78 could be fixedly secured to the front and rear axles 20 and 26, respectively, for rotation with those axles, if desired. However, each of the front and rear axles 20 and 26 is coupled with the third shaft 70 through a first, front and a second, rear slip clutch indicated generally at 80 and 82, respectively. With the provision of slip clutches 80 and 82, each of the first and second worm gears 76, 78 is mounted for free rotation on the front and rear axles 20 and 26, respectively.

Figure 5:
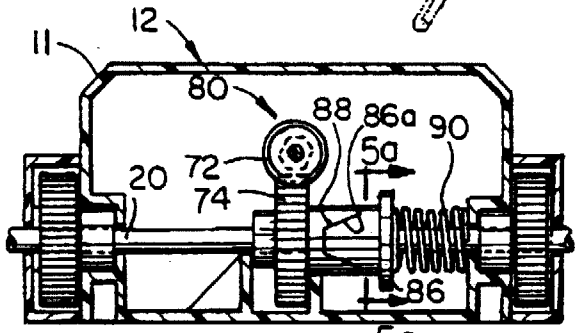
FIG. 5 is a cross-section taken along the lines of 5—5 of FIG. 3.
Figure 4:
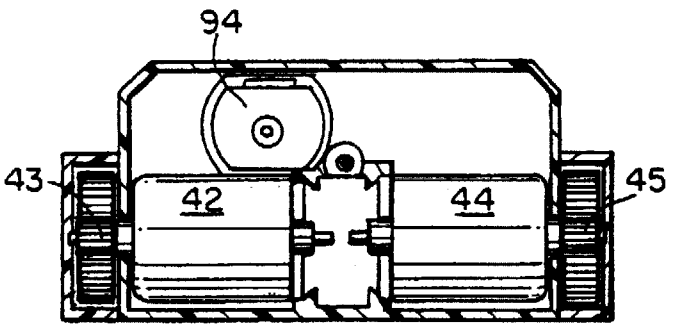
FIG. 4 is a cross-section taken along the lines 4—4 of FIG. 3.
Figure 5A:
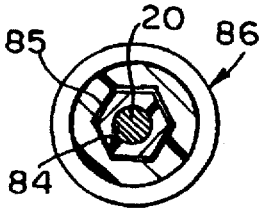
FIG. 5*a* is a cross-section taken along the lines 5*a*—5*a* of FIG. 5.

FIG. 5 is an end view of slip clutch 80. FIG. 5*a* is a cross-sectional view of FIG. 5. Slip clutch 80 includes a key block 84 (in phantom in FIG. 5 and in solid in FIG. 5*a*) fixedly secured on the axle 20 for rotation with the axle 20. The key block 84 may have a geometric from such as a hexagon as depicted, or a square, pentagon, etc. A collar 86 having a mating geometrically shaped bore 85 (FIG. 5*a*) is slidably mounted on the key block 84. A side face of the first worm gear 76 facing the key block 84 is provided with a truncated V-shaped indentation 88 while the side of the collar 86 facing the gear 76 is provided with a mirror image truncated V-shaped projection 86*a* for mating engagement with the truncated V-shaped indentation 88. A coil spring 90 is provided on the axle 20 biasing the collar 86 against the facing side of the worm gear 76 to keep the truncated V-shaped projection 86*a* engaged with the truncated V-shaped indentation 88 on the worm gear 76. In this way, the axle 20 is rotatably engaged through the key block 84, collar 86, worm gear 76 and worm 72 with the third shaft 70. The rear slip clutch 82 is of identical construction and is shown decoupled in FIG. 2.

The slip clutches 80 and 82 also constitute keyed couplings between the axles and shaft and indirectly the chassis, which permit the axles to be rotated to either of a two discrete angular positions and to be reengaged and held in those new positions. Preferably, a lever 92 is pivotally supported on the chassis 12 with one end in contact with the collar 86 of the rear slip clutch 82 and an opposing end projecting outwardly from the housing 11. The lever 92 can be used to manually disengage the rear axle 26 from the worm gear 78 and effectively from third, accessory shaft 70 and the chassis to permit free rotation of the rear axle 26. Alternatively or additionally, a like lever 92' (in phantom in FIG. 2) could be provided for manual operation of the front axle slip clutch 80.

Figure 6:
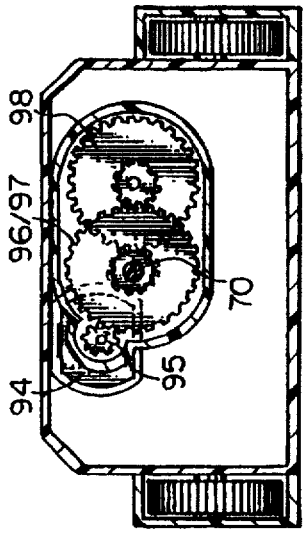
FIG. 6 is a cross-section taken along the lines 6—6 of FIG. 3.

The third, accessory shaft 70 is selectively rotated by means of a third, accessory motor 94. Motor 94 drives a pinion 95 which is drivingly coupled with a gear 96 fixedly mounted to the third shaft 70 by a pair of compound reduction gears 97 and 98. Gear 97 is mounted for free rotation on the accessory shaft 70. An end view of the arrangement is also provided in FIG. 6. Activation of the accessory motor 94 rotates the shaft 70 and causes the simultaneous rotation of the front and rear axles 20, 26. Axles 20, 26 rotate each of the wheel support housings 32 fixedly secured to the free ends of those axles, causing the vehicle to reconfigure itself in various ways depicted schematically in FIG. 7. The truncated V-shaped projection **86*a* and indentation 88 of the slip clutch 82 engage the rear axle 26 with the accessory shaft 70 and accessory motor 94 in either of two discrete orientations of the axle 26 separated by 180°. The truncated V-shaped slip clutch coupling permits the rear wheels and wheel support housings supporting the rear wheels to be located either 180° out of phase with the front axle and front wheel, as shown in FIGS. 1–3**, or in phase with the front wheels and front axle.

Slip clutches 80 and 82 also function as suspensions for the wheels 22, 24, 28 and 30. The truncated V-shaped protrusion **86*a* and indentation 88 of each clutch 80 and 82 will remain drivingly engaged with one another for approximately 15° of rotation in either direction about their fully seated positions. This enables the front pair of wheels and the rear pair of wheels to move in response to shocks and impacts independently of each other pair. The coil spring 90 associated with each slip clutch 80, 82 will absorb the energy of such shocks and impacts. The spring(s) 90 will bias the truncated V-shape projection 86*a* and indentation 88 together to automatically reseat themselves and return the wheel support housings back to their original, nominal angular positions with respect to their supporting axle and the chassis. Should the impact be so great to cause the protrusion 86*a* and indentation 88 to disengage, activation of the accessory motor 94 will cause the worms 72, 74 to rotate the worm gears 76, 78** until the unseated indentation realigns and reseats.

Figure 7:
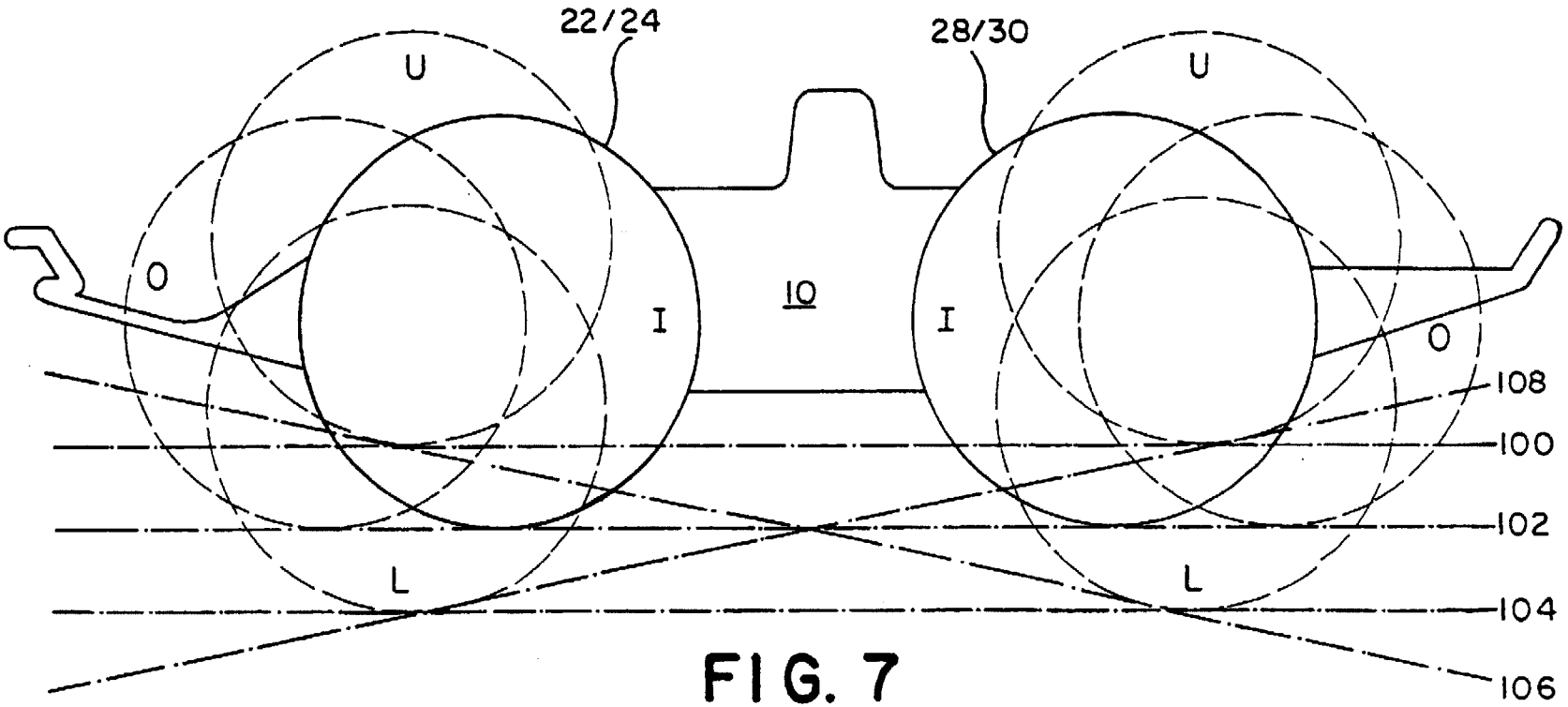
FIG. 7 is a schematic illustrating various possible orientations of the front and rear wheels.

FIG. 7 depicts in solid, the innermost possible positions of the front wheels 22/24 and rear wheels 28/30. These are denoted in the figure by the letter "I". Also depicted in phantom at the front and rear ends 13 and 14 of the vehicle 10 are the lowermost, outermost and uppermost positions of those wheels, which are indicated by the letters "L", "O" and "U", respectively. Three horizontal lines 100, 102 and 104 are indicated in FIG. 7. The middle horizontal line 102 represents the location of the bottoms of the wheels 22, 24, 28, 30 of vehicle 10 when they are located in the outermost ("O") and/or innermost ("I") positions. Upper line 100 represents the locations of the bottoms of the wheels when all are in the uppermost ("U") position. The bottom line 104 represents the locations of the bottoms of the wheels when all are located in the lowermost ("L") position. Two diagonal lines 106 and 108 are also indicated. Diagonal line 106 shows the positions of the wheels when they are 180° out of phase with the front wheels 22, 24 located in their uppermost position and the rear wheels 28, 30 located in their lowermost position. Diagonal line 108 represents the positions at the bottoms of the wheels in the opposite arrangement with the front wheels 22, 24 in their lowermost position and rear wheels 28 and 30 in their uppermost position.

Independent radio control of twin propulsion motors is well known and is disclosed, for example, in U.S. Pat. No. 5,135,427 which is incorporated by reference herein in its entirety. A remote hand control unit 110 is further depicted in FIG. 1. The unit includes a left propulsion control switch 112, a right propulsion control switch 114, an accessory motor control switch 116, and a power switch 118. A separate channel or frequency band can be used to provide a control signal from the unit 110 to the radio receiver 56 and control circuit 54 to operate the accessory motor 94. The control circuit 54 is configured to recognize and respond to such a signal from the remote control unit 110 directing operation of the accessory motor 94 by supplying power from supply 60 to the accessory motor 94.

Vehicle 10 is operated as follows. Initially the wheels of the vehicle 10 are configured to be in phase with one another or 180° out of phase with one another. If it is desired to change the existing wheel phase configuration, the lever 92 is pivoted disengaging the collar 86 of the rear clutch 82. The rear axle 26 can then be rotated 180° from its existing angular orientation to reverse the relative phases of the wheels from their existing relative phase relation. When the front and rear axles 20 and 26 are in phase, each of the wheels 22, 24, 28, 30 are located in the same angular orientation with respect to a common reference. Thus, all of the wheels are in their forwardmost or rearwardmost or uppermost or lowermost positions at the same time. When the front and rear wheels are out of phase, they are in exactly opposite positions, i.e. forward with rearward, up with down.

Using the left and right propulsion switches 112 and 114 of the remote control unit 110, the vehicle 10 can be driven forward (both switches forward) or in reverse (both switches drawn back) or turned in either direction (moving only one of the two switches) or turned very sharply or even spin about its center (moving the two switches in opposite directions). At any time, the accessory motor 94 can be actuated by means of the accessory motor switch 116 on the remote control unit 110. Activation of the accessory motor 94 rotates the third shaft 70 which, through the couplings 71 and 73, rotate the front and rear axles 20 and 26, respectively, changing the angular orientation of those axles and of the wheel support housings and wheels supported at the ends of those axles. If the wheels are in phase, the height of the vehicle can be adjusted, although the chassis will remain level and parallel with a plane tangent to the bottoms of all of the wheels. Where the front and rear pairs of wheels are out of phase, the body will either be pitched with one of the front end 13 and rear end 14 raised above the other, except when the wheels are located at their innermost (I) or outermost (O) positions.

Angular orientation of each of the wheels 22, 24, 28, 30 with respect to its supporting axles 20, 26 can be measured with respect to a line plum vertical up through central axis 21 or 27 of the axle 20 or 26 supporting the wheel and a line connecting that center line with the geometric center 23, 25, 29 or 31 of the wheel. If a counterclockwise convention is adapted, the axle and wheels are in the 0° position when the wheels are at their uppermost position, in the 90° position when they are in their forwardmost position, 180° when in the downwardmost position and 270° when in the rearwardmost position.

This ability to reconfigure the wheel does more than merely alter the appearance of the vehicle in an unusual way. It affects the performance of the vehicle. For example, when the front and rear wheels are out of phase with the wheels in their outermost (O) position, the resulting long wheel base provides increased track for straight line running stability. When the pairs of wheels are in their innermost positions (I), providing the shortest wheel base, the vehicle, if sufficiently powered, will be able to perform high speed spins generally about its center between the two pairs of wheels. When the wheels are in phase and in their lowermost positions (L), extremely high ground clearance for the chassis is provided for off-road use. Conversely, when the wheels are raised to their uppermost positions (U) providing the least ground clearance, the vehicle 10 is most stable for high speed turns on a smooth support surface. Furthermore, the weight balance of the vehicle can be shifted by raising one end and lowering the other end when the wheels are out of phase to affect handling. For example, dropping the nose and raising the rear shifts the vehicle weight forward and makes the vehicle 10 tend to understeer. Raising the nose and dropping the rear shifts the center of gravity rearward and causes the vehicle 10 to tend to oversteer.

If desired, the accessory motor can be reversible and/or variable speed. The remote control unit 110 and control circuit 54 can be configured so that the accessory motor 94 operates as long as the accessory motor switch 116 is closed or a stepper arrangement can be provided such that the accessory motor 94 rotates a sufficient number of revolutions to rotate each axle 20, 26 90° each time the accessory motor switch 116 is depressed.

In addition to offering a means to reconfigure and reorient the vehicle while it is being propelled at a relatively rapid rate by the propulsion motors 42, 44, it is also possible to propel the vehicle 10 simply by operation of the accessory motor 94. The vehicle 10 will proceed in a straight line at a rather slow speed if the propulsion motor 94 is permitted to operate continuously. If the wheels are in phase, the chassis 12 will remain level but rise up and drop as the axles 20 and 26 are rotated. If the wheels are out of phase, the chassis 12 will undulate as the vehicle 10 moves in a straight line on the rotation of the axles 20, 26.

While the present embodiment discloses remotely controlled reconfiguration of the system, it will be appreciated that the vehicle could be configured to permit only manual reconfiguration. Those of ordinary skill will further appreciate that other propulsion arrangements could be provided, if desired, including a single motor driving wheels on both lateral sides of the vehicle through a transmission and twin motors operating together through a transmission to drive wheels on both lateral sides of the vehicle. Although all four wheels preferably are driven for propulsion, only two, one on each side, need to be driven to provide propulsion and steering. Less desirably, the same motor(s) used to provide propulsion could also be used to power rotation of one or both axles directly or through a third shaft as disclosed. Also, one motor could be provided for each wheel and could be provided in the chassis or in each wheel or each wheel support housing. One or both axles could be rotated continuously without selective activation and indeed, the propulsion drives could be deleted entirely and the vehicle propelled solely by driving one or both of the axles. The wheels could be rotated by means of the front and rear axles 20, 26 and the wheel support housings 32 rotated by means of collars surrounding the axles, reversing the depicted arrangement. While the motors 42, 44 and 94 are all shown in the rear of vehicle 10, they could be located in the front or spread out at virtually any desired position within the chassis 12.

The described vehicle could further be provided in an unpowered version. Instead of slip clutching the front and rear axles to the chassis through the worm gears, worms, third axle, etc., they could be slip clutched directly or more directly to the chassis. A second lever 92' could be provided in place of or in addition to lever 92 for manual operation of the other slip clutch so that either or both axles 20 and 26 could be positioned independently. In such an embodiment the slip clutches would preferably be configured to provide more than two distinct angular orientations to compensate for the lack of flexibility that was provided by the accessory drive motor and third shaft. If desired, differently shaped mating projections **86*a* and indentations 88** could be provided (e.g., triangular, square, etc.) to provide more than two discrete angular orientations in which the rear axle (or front) can be coupled with the third shaft and accessory motor (or directly to the chassis). Alternatively, smooth mating friction surfaces (e.g. circular or conical) could be provided for a continuous range of angular adjustment.

Spring biased slip clutches like 80, 82 with angled mating surfaces **86*a*, 88 are preferred because they provide an angular range of continued engagement. Other types of adjustable keyed couplings such as an axle collar and chassis part having mating castellated faces could be provided to permit selective, non-slip engagement of either or both wheel axles with the chassis or third shaft in almost any desired plurality of discrete angular positions. Such adjustable keyed couplings would be equivalent to the disclosed slip clutches in permitting rotation of the wheel axle in question with respect to the chassis or third shaft. Such couplings would not provide protection to the various drive gears in the wheel housings and/or the gear trains or the suspension of the running gear provided by preferred slip clutches 80**.

The wheels could be mounted for free rotation on the wheel support housings. Alternatively, the wheels could be fixedly mounted on the wheel support housings or the outer perimeters of the wheel support housings configured as the wheels and the front and rear axles remain linked together through the third shaft for simultaneous rotation of the axles synchronized through the third shaft, which would be unpowered. Bevel gears could be substituted for the worm and worm gears to permit rotation through the third axle.

While the tires of all the wheels 22, 24, 28, 30 could be identical, preferably the rear tires 28, 30 are provided with more traction than the front tires 22, 24 for improved forward running stability. The traction of the tires can be varied in different ways such as varying the size or the tread or the knobs or the material or the hardness of the tires, or by a combination of these ways.

Although wireless radio controllers describe other types of wireless control, including light and sound, could be used. Although wireless control is preferred, wired or "tethered" control could also be used. The power supply might be located in the remote hand control unit or in the vehicle with a wired remote control unit.

Key blocks 84 may be plastic and molded in place on the metal axles 20, 26 or may be of metal (e.g. brass nuts) and press fit onto harder metal (e.g. steel) axles.

It will be appreciated by those skilled in the art that still other changes could be made to the embodiment described above without departing from the broad inventive concept thereof. It is understood, therefore, that this invention is not limited to the particular embodiment(s) disclosed, but it is intended to cover modifications within the spirit and scope of the present invention as defined by the appended claims.

We claim:

1. A toy vehicle comprising:

a chassis having opposing lateral sides;

an axle having a central axis and supported by the chassis for rotation with ends of the axle extending laterally outwardly from the opposing lateral sides of the chassis;

a pair of vehicle supporting, ground contacting wheels located parallel to one another on the opposing lateral sides of the vehicle; and a pair of wheel support housings, each wheel support housing being fixedly secured on a separate end of the axle at a location on the wheel support housing off geometric center of the wheel support housing for eccentric rotation of the wheel support housing on the axle with rotation of the axle, each wheel of the pair being mounted on a separate one of the pair of wheel support housings for rotation on the one wheel support housing and with respect to the wheel support housing about a geometric center of the wheel radially displaced away from the central axis.

2. A toy vehicle comprising:

a chassis having opposing lateral sides;

an axle having a central axis and supported by the chassis for rotation with ends of the axle extending laterally outwardly from the opposing lateral sides of the chassis;

a pair of vehicle supporting, ground contacting wheels located parallel to one another on the opposing lateral sides of the vehicle;

a pair of wheel support housings, each wheel support housing being fixedly secured on a separate end of the axle at a location on the wheel support housing off geometric center of the wheel support housing for eccentric rotation of the wheel support housing about the axle with rotation of the axle, each wheel of the pair being mounted on a separate one of the pair of wheel support housings for rotation on the one wheel support housing about a geometric center of the wheel radially displaced away from the central axis;

a first wheel drive gear mounted on the axle for free rotation with respect to the axle on one lateral side of the chassis proximal one of the pair of wheels; and a first driven wheel gear in engagement with the first wheel drive gear and fixedly coupled with the one wheel for rotation with the one wheel about the geometric center of the one wheel.

3. The toy vehicle of claim 2 further comprising a second wheel drive gear independent of the first wheel drive gear mounted on the axle for free rotation with respect to the axle on a remaining lateral side of the chassis proximal a second, remaining one of the pair of wheels; and a second driven wheel gear in engagement with the second wheel drive gear and fixedly coupled with the second wheel for rotation with the second wheel about the geometric center of the second wheel.

4. The toy vehicle of claim 3 further comprising a first wheel motor drivingly coupled with the first wheel drive gear.

5. The toy vehicle according to claim 4, further comprising a second wheel motor drivingly coupled with the second wheel drive gear.

6. The toy vehicle according to claim 5 further comprising:

a second axle supported by the chassis for rotation with ends of the second axle extending laterally outwardly from the opposing lateral sides of the chassis;

a second pair of vehicle-supporting wheels located parallel to one another on the opposing lateral sides of the chassis; and a second pair of wheel support housings, each housing of the second pair being fixedly secured on a separate end of the second axle at a location on the housing off geometric center of the housing for eccentric rotation of the wheel support housing about the second axle with rotation of the second axle, each wheel of the second pair being mounted on a separate one of the second pair of the wheel support housings for rotation on the wheel support housing about a geometric center of the wheel.

7. The toy vehicle of claim 2 further comprising:

a driven axle gear mounted on the axle and engaged with the axle for rotation with the axle;

an axle drive gear engaged with the driven axle gear; and an accessory motor drivingly coupled with the axle drive gear.

8. The toy vehicle of claim 7 further comprising a slip clutch between the axle and the chassis.

9. The toy vehicle of claim 8 wherein the slip clutch is keyed to engage the axle in at least two discrete angular orientations of the axle.

10. The toy vehicle of claim 2 wherein each of the pair of wheel support housings is fixedly coupled with a separate one of the ends of the axle and further comprising a slip clutch releasably rotatably coupling the axle with the chassis.

11. A toy vehicle comprising:

a chassis having opposing lateral sides;

a first axle having a central axis and being supported by the chassis for rotation on the chassis about the central axis of the first axle;

at least a first wheel supported on the first axle with a geometric center of the first wheel being radially displaced away from the central axis of the first axle in all possible configurations of the first wheel with respect to the first axle;

a second axle having a central axis and being supported on the chassis for rotation on the chassis about the central axis of the second axle, the central axes of the first and second axles being parallel to one another and longitudinally displaced from one another on the chassis;

at least a second wheel supported on the second axle with geometric center of the second wheel being radially displaced away from the central axis of the second axle in possible configurations of the second wheel with respect to the second axle; and a shaft rotatably coupled with each of the first and second axles for simultaneous rotation of the shaft with the first and second axles.

12. The toy vehicle of claim 11 further comprising an accessory motor drivingly coupled with the shaft.

13. The toy vehicle of claim 12 wherein the accessory motor is electric and further comprising a radio receiver and a battery coupled with the radio receiver and with the accessory motor.

14. The toy vehicle of claim 13 further comprising:

a first pair of wheel support housings mounted on separate ends of the first axle on the opposing lateral sides of the vehicle, each wheel support housing of the pair being fixedly secured on the first axle off geometric center of the wheel support housing for eccentric rotation of the wheel support housing about the first axle with rotation of the first axle, and each wheel of the first pair of wheels being mounted on a separate one of the first pair of wheel support housings for rotation on the separate wheel support housing about a geometric center of the wheel; and a first propulsion motor drivingly coupled with at least one of the first pair of wheels on one lateral side through at least the separate wheel support housing on which the one wheel is mounted.

15. The toy vehicle of claim 14 further comprising:

a second pair of wheel support housings mounted on separate ends of the second axle on the opposing lateral sides of the vehicle, each wheel support housing of the second pair being fixedly secured on the second axle off geometric center of the wheel support housing for eccentric rotation of the wheel support housing about the second axle with rotation of the second axle, and each wheel of the second pair of wheels being mounted on a separate one of the second pair of wheel support housings for rotation on the respective separate wheel support housing about a geometric center of the wheel; and a second propulsion motor drivingly coupled separately of the first motor with at least another one of the first and second pairs of wheels on a remaining one of the lateral sides through at least the wheel support housing on which the other one wheel is mounted.

16. The toy vehicle of claim 11 further comprising a first slip clutch between the shaft and the first axle.

17. The toy vehicle of claim 16 further comprising a second slip clutch between the shaft and the second axle.

18. A toy vehicle comprising:

a chassis having opposing lateral sides;

a first axle having a central axis, the first axle being supported laterally on the chassis for rotation about the central axis of the first axle;

a first pair of wheels supported on separate ends of the first axle on either of the opposing lateral sides of the chassis with geometric centers of the first pair of wheels being radially displaced away from the central axis of the first axle;

a second axle having a central axis, the second axle being supported laterally on the chassis for rotation about the central axis of the second axle with ends of the first axle projecting laterally outwardly from the opposing lateral sides of the chassis;

a second pair of wheels supported on separate ends of the second axle on either of the opposing lateral sides of the chassis with geometric centers of the second pair of wheels being radially displaced away from the central axis of the second axle; and motor means drivingly coupled with at least one driven wheel on each of the opposing lateral sides of the vehicle for rotating each driven wheel without rotation of either of the first and second axles.

19. The toy vehicle of claim 18 further comprising a first keyed coupling between the first axle and the chassis.

20. The toy vehicle of claim 19 further comprising:

a second keyed coupling between the second axle and the chassis.

21. A toy vehicle comprising:

a chassis;

a first axle having a first central axis and being supported laterally on the chassis for rotation on the chassis about the central axis;

a first vehicle-supporting, ground-contacting wheel having a geometric center; and a first wheel support housing supporting the first wheel for rotation of the first wheel on the wheel support housing and with respect to the first wheel supporting housing about the geometric center of the first wheel, the wheel support housing being supported on the first axle for rotation of the first wheel support housing with respect to the chassis, the first central axis being radially displaced away from the geometric center of the first wheel and at least one of the first wheel and the first wheel support housing being engaged with the first axle for rotation with rotation of the first axle.

22. The toy vehicle of claim 21 further comprising a driven gear fixedly coupled with the first wheel for rotation of the first wheel with the driven gear and a drive gear mounted on the first axle and meshed with the driven gear to drive the driven gear.

23. The toy vehicle of claim 21 wherein one of the first wheel and the first wheel support housing is engaged with the first axle for rotation with rotation of the first axle.

24. A toy vehicle comprising:

a chassis;

a first axle having a first central axis and being supported laterally on the chassis for rotation on the chassis about the central axis;

a first vehicle-supporting, ground-contacting wheel having a geometric center;

a first wheel support housing supporting the first wheel for rotation of the first wheel on the wheel support housing about the geometric center of the first wheel, the wheel support housing being supported on the first axle for rotation of the first wheel support housing with respect to the chassis, the first central axis being radially displaced away from the geometric center of the first wheel, one of the first wheel and the first wheel support housing being engaged with the first axle for rotation with rotation of the first axle; and a collar rotatably mounted on the first axle and engaged with a remaining one of the first wheel and the first wheel support housing for rotation of the remaining one with rotation of the collar on the first axle.

25. The toy vehicle of claim 24 further comprising a motor drivingly coupled with the first axle.

26. The toy vehicle of claim 24 further comprising a motor drivingly coupled with the collar.

27. The toy vehicle of claim 26 further comprising a separate motor separately drivingly coupled with the first axle.

28. A toy vehicle comprising:

a chassis;

a first axle supported laterally on the chassis for rotation on the chassis;

a first vehicle-supporting, ground-contacting wheel having a geometric center;

a first wheel support housing supporting the first wheel for rotation of the first wheel on the wheel support housing and with respect to the wheel support housing about the geometric center of the first wheel, the wheel support housing being supported from the chassis for rotation about an axis displaced radially away from the geometric center of the first wheel; and a first slip clutch rotatably coupling the first wheel support housing with the chassis, the first slip clutch including a spring mounted to permit a limited rotational movement of the wheel support housing with respect to the chassis about a nominal angular position on the first axis and to bias the wheel support housing back to the nominal angular position within the range of limited angular movement.

29. A toy vehicle comprising:

a chassis having opposing lateral sides;

a first axle having a central axis, the first axle being supported laterally on the chassis for rotation about the central axis of the first axle;

a first pair of wheels supported on separate ends of the first axle on either of the opposing lateral sides of the chassis with geometric centers of the first pair of wheels being radially displaced away from the central axis of the first axle;

a second axle having a central axis, the second axle being supported laterally on the chassis for rotation about the central axis of the second axle with ends of the first axle projecting laterally outwardly from the opposing lateral sides of the chassis;

a second pair of wheels supported on separate ends of the second axle on either of the opposing lateral sides of the chassis with geometric centers of the second pair of wheels being radially displaced away from the central axis of the second axle; and a motor drivingly coupled with at least one driven wheel on each of the opposing lateral sides of the vehicle so as to rotate each driven wheel without corresponding rotation of either of the first and second axles.

* * * * *